US006098844A

United States Patent [19]

Nicolle

[11] Patent Number: 6,098,844

[45] Date of Patent: Aug. 8, 2000

[54] WATER DISPENSING SYSTEM

[75] Inventor: Kenneth Nicolle, P.O. Box 70, Zephyr, Ontario, Canada, L0E 1T0

[73] Assignee: Kenneth Nicolle, Unionville, Canada

[21] Appl. No.: 09/012,212

[22] Filed: Jan. 23, 1998

[51] Int. Cl.[7] ..... B67D 5/00

[52] U.S. Cl. ..... 222/80; 222/105; 222/185.1

[58] Field of Search ..... 222/80, 81, 83.5, 222/92, 96, 105, 146.6, 67, 185.1; 206/484

[56] References Cited

U.S. PATENT DOCUMENTS

| | | | |
|---|---|---|---|
| 3,255,923 | 6/1966 | Soto | 206/484 |
| 3,848,776 | 11/1974 | Schieser | 222/105 |
| 4,322,465 | 3/1982 | Webster | 206/484 |
| 4,527,716 | 7/1985 | Haas et al. | 222/83.5 |
| 4,795,062 | 1/1989 | Bedwell et al. | 222/92 |
| 4,846,236 | 7/1989 | Deruntz | 222/81 |
| 5,325,995 | 7/1994 | Harrison et al. | 222/81 |
| 5,334,180 | 8/1994 | Adolf et al. | 222/81 |
| 5,505,336 | 4/1996 | Montgomery et al. | 722/82 |
| 5,567,322 | 10/1996 | Rundle et al. | 222/146.6 |

FOREIGN PATENT DOCUMENTS

| | | | |
|---|---|---|---|
| 0 250 640 | 1/1988 | European Pat. Off. . | |
| 2 685 293 | 6/1993 | France | 222/187 |

*Primary Examiner*—Andres Kashnikow
*Assistant Examiner*—Jorge Bocanegra

[57] ABSTRACT

A water dispensing system has collapsible water bags locatable on a stand above a water cooler. The water cooler may be of conventional form or any convenient form having a cooling reservoir. A conduit leads from the collapsible bag into the cooling reservoir and is provided with a control valve to control the flow of water into the reservoir. The stand may be locatable on the top of the water cooler and have a bowl to hold the water bag. A sharp extension of the conduit extends upwardly into the bowl to puncture the water bag when It is placed in the bowl. The bags may be provided with a peel-off cover for reasons of hygiene. The peel-off cover may be removed immediately before the bag is located in the bowl. Advantages of the collapsible bag water dispensing system include easy of location of the bag in the water cooler. Lids may be provided above both the bag and for the cooling reservoir to further enhance hygiene.

12 Claims, 5 Drawing Sheets

WATER DISPENSING SYSTEM

BACKGROUND OF THE INVENTION

1. Field of the Invention

This invention relates to a system for dispensing water to domestic water coolers.

2. Acknowledgement of Prior Art

By domestic water coolers are meant water coolers which are used in a domestic, small office, cafeteria or canteen environment. They are usually free standing and are supplied from larger water bottles which must be up-ended so that the neck points downwardly and the mouth of the bottle is located ill the water cooler reservoir. Such bottles may contain a large quantity of water for example in the region of about 5 gallons. Up-ending one of these bottles in order to locate it properly upside down over a water cooler is not easy and for a small individual may be nearly impossible. Other people who have problems in handling such bottles are those with back problems and the elderly to whom a supply of clear, sterile water may be extremely important.

Even for the able bodied, handling of the water bottles and positioning them may be regarded as an art form. The skill is in spilling as little water as possible in up-ending the open bottle and placing the bottle in position.

The bottles used with such water coolers are not only large but are formed from plastic material at least sufficiently rigid to hold its shape and strong enough to contain and protect the water without fear of breakage or puncture. An appreciable amount of plastic is used in such bottles and they are, therefore, sufficiently expensive to be worth sterilizing and reusing. Indeed, if they were to be disposed of as garbage by the user, disposal would be a problem.

Sterilization of the bottles for reuse is itself a major problem. In order that the mouth of the bottle may be located in the cooling reservoir of the cooler, the bottles are necessarily necked. Sterilization using sterilizing agents is difficult due to the necessity of reaching all interior parts of the bottle. Large quantities of liquid may be used and even then the sterilization may not be absolute. Sterilization using ultraviolet light is also possible but this may also be subject to an incomplete result. Generally it is not possible to use heat sterilization on plastic bottles.

Thus, although the conventional system of up-ending large plastic bottles to dispense their contents in a controlled manor into water coolers is well established, it clearly has some problems associated with this conventional system. The bottles are difficult and clumsy to handle and may spill during location and sterilization of the bottles for reuse is difficult.

The present inventor has addressed these problems.

SUMMARY OF THE INVENTION

Accordingly the invention provides a water dispensing system comprising a cooler having a cooling reservoir replenishable from above; a collapsible, sealed, plastic bag of water; a connector between said cooler and said bag comprising a bowl for said bag, means to hold the bowl above the cooling reservoir of said cooler, a conduit for water extending between the bowl and the cooling reservoir, means within said bowl to penetrate said bag when placed within said bowl to allow water to flow into said conduit, and valve means to control flow of water from the conduit in dependence on the level of water in the water reservoir.

It should be noted that although it may be convenient to form the bowl of circular horizontal section; other configurations, such as square or oval, are possible.

The means to hold the bowl over the cooling reservoir may be a stand for the bowl supportable upon the cooler. The stand and the bowl may be an integral, rigid, molding of plastics material, e.g. polyvinylchloroethylene. The bowl may be provided with a shoulder near its rim to hold a lid over the bowl.

The means to penetrate the bag to allow water to flow into the conduit may be a hollow conduit extension upstanding from a bottom internal surface and terminating in a sharp edge to penetrate said bag. The hollow interior of the extension communicates, on the one hand, through the bottom of the bowl with the conduit and, on the other hand, with the interior of the bowl, or when the bag is located in the bowl, with the interior of the bag.

Drain means of the extension for communicating with the interior of the bags may be located sufficiently above said bottom internal surface of the bowl to access the interior of the bag.

The conduit extension may comprise a hollow cone having a sharp closed apex and open into the conduit through its base, the drain means comprising at least one aperture through the sidewall of said cone. Alternatively, the drain means might be an upstanding open tube having a sharp upper edge. Both the penetrating efficiency and the ability to drain from the lower part of the bowl may be advantageous if the top of such tube is angled.

The water bag itself may be formed from polyethylene sheet of food grade and sufficient strength to hold the required volume of water. The bag may be formed from two sheets of polyethylene heat sealed together.

A watertight seal is provided between said extension and the conduit and between the bowl and the extension where the extension passes though the bottom of the bowl. The seal at the bottom of the bowl may help to prevent any water which may leak from the bag into the bowl from dripping into the cooling reservoir beneath.

The polyethylene film, which may have a gauge between 2–5 mil, preferably around 3 mil.

The film may be heat sealed around the sides and the bottom of the bag. The top of the bag may be open before the bag is filled if the bag is to be filled using filling machinery which will hold the top of the filled bag together for sealing.

Alternatively the empty bag may be sealed along an appreciable length of its top leaving only a small aperture to allow filling through a nozzle. The small aperture is reasonably easy to seal after the bag is filled.

For reasons of hygiene the water bag may be provided with a peel-off cover for removal before placing said bag in said bowl. The bag preferably has a handle at a top end thereof.

The valve means to control flow of water in the conduit is a ballcdck supply valve in the cooler reservoir and a lid may be provided for the cooler reservoir.

BRIEF DESCRIPTION OF THE DRAWINGS

An embodiment of the invention will now be described by way of example with reference to the drawings, in which.

DETAILED DESCRIPTION OF A PREFERRED EMBODIMENT

Figure 1:
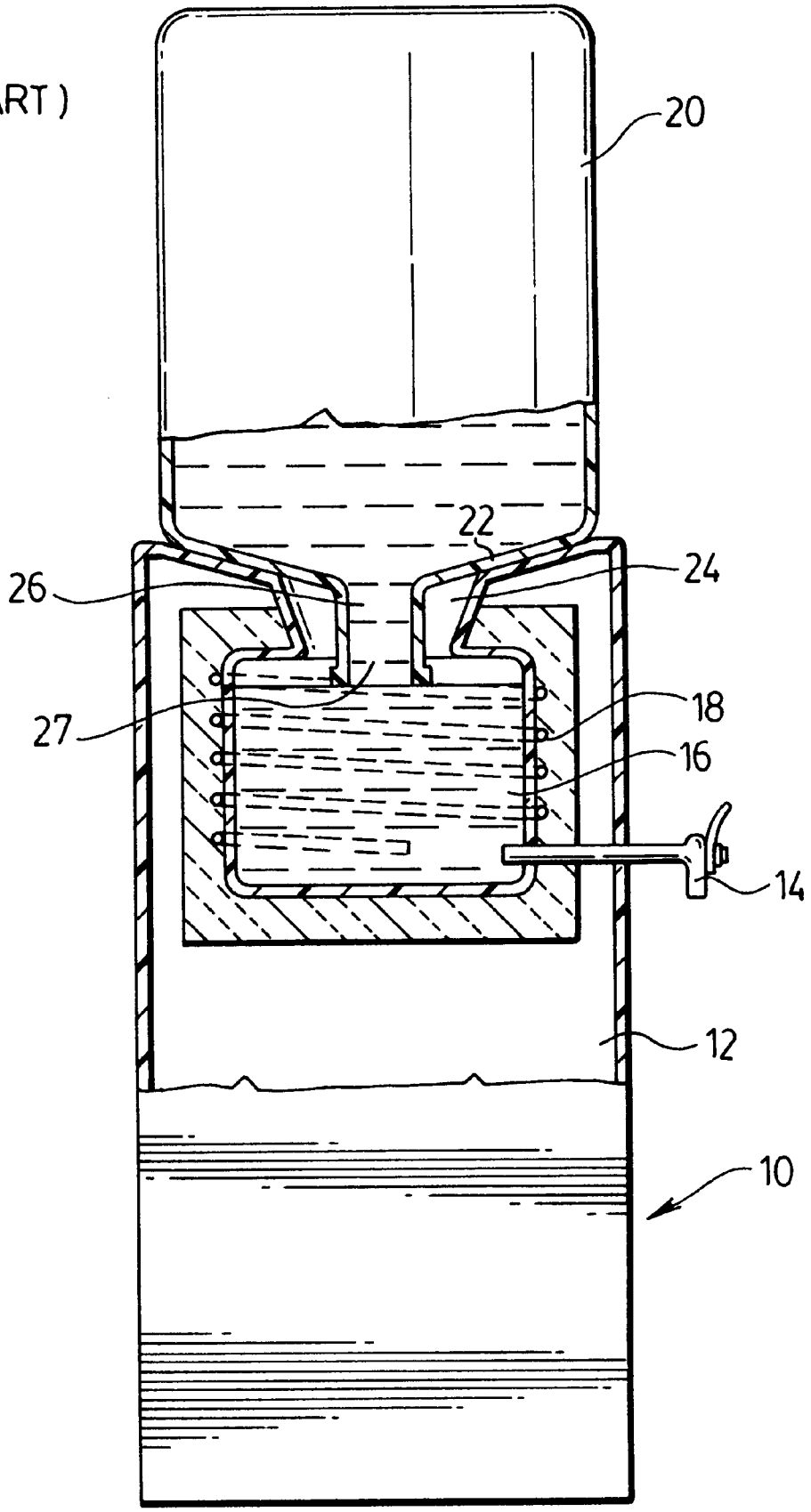
FIG. 1. (PRIOR ART)
FIG. 1 shows an illustration of a conventional water cooler as known in the prior art.

A conventional water cooler 10 is shown in FIG. 1. Such a water cooler comprises a housing 12 which is usually sufficiently tall to be free standing on the floor with an access tap 14 conveniently accessible to a user wishing to draw cool water from it. The cooler 10 includes a cooling reservoir 16 within the housing 12, open at the top and having refrigerating coils 18 arranged around it. A water bottle 20 is located upside down resting in a shallow saucer 22 at the top of the water cooler housing. The shallow saucer 22 has a simple aperture 24 through which the neck 26 of the bottle 20 protrudes so that it is located within and above the cooling reservoir 16. The mouth 27 of the bottle is located just below a desired upper water level for the cooling reservoir.

In operation water is retained in bottle 20 by atmospheric pressure until sufficient water is drawn water is drawn off through tap 14 from the cooling reservoir 16 to reduce the level of water in the cooling reservoir 16 below the mouth 27 of bottle 20. When this happens air enters bottle 20 and water is displaced into a cooling reservoir 16 until the level of water is again above the mouth 27 of bottle 20.

Figure 2:
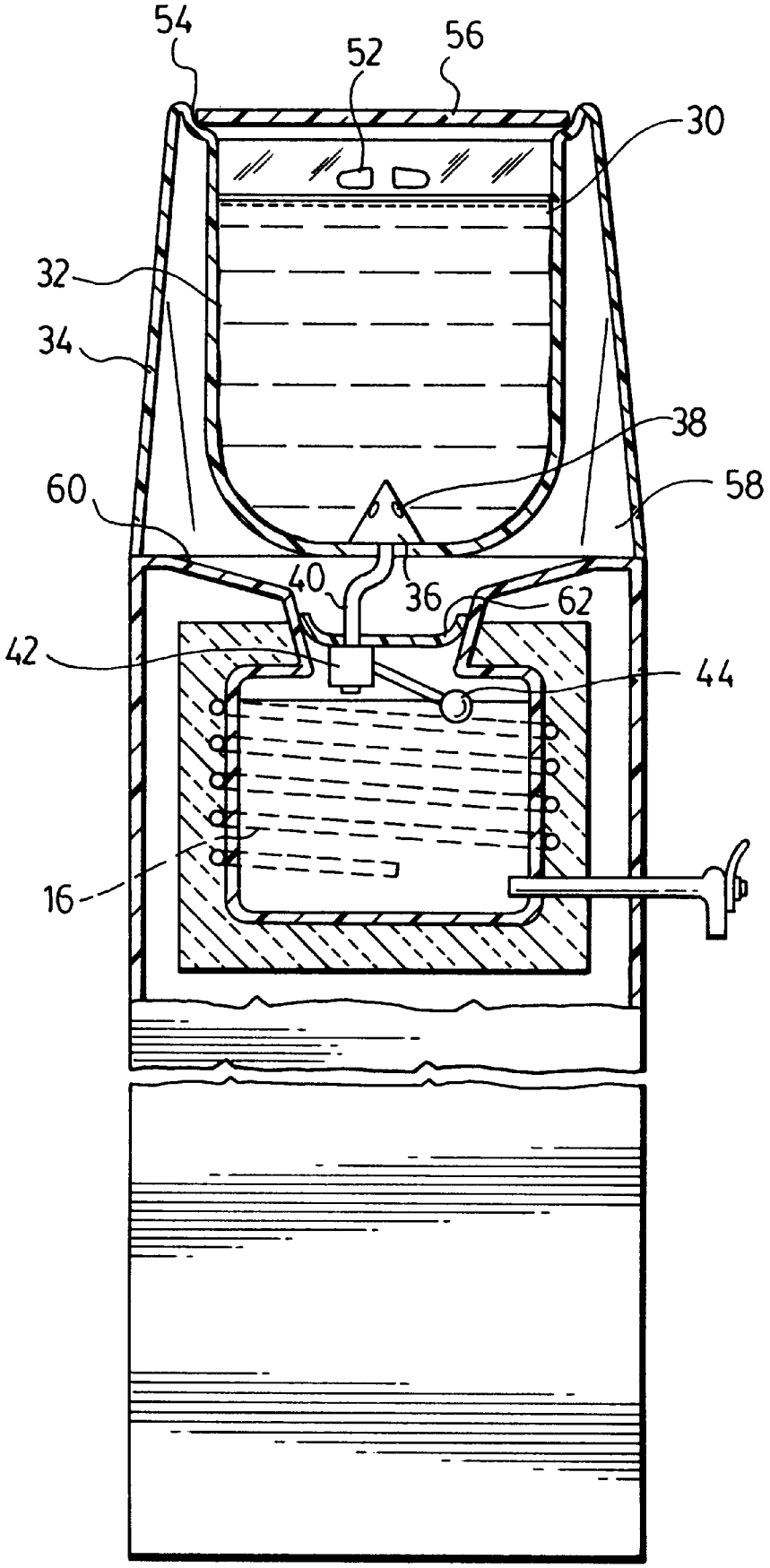
FIG. 2 shows a water dispensing system according to the invention.
Figure 3:
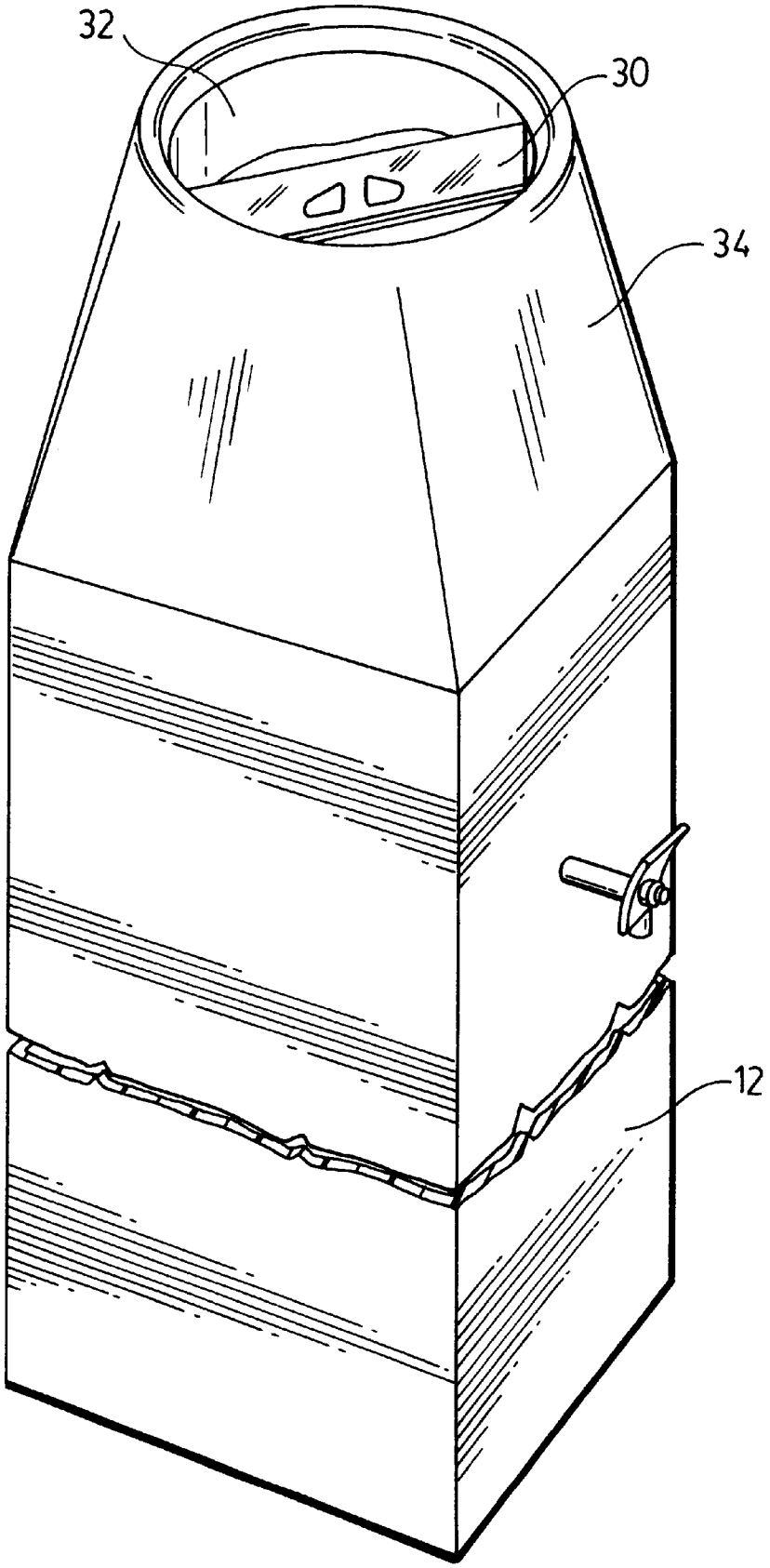
FIG. 3 shows the integral molded connector stand and bowl supported on the water cooler.

The operation of a water dispensing system of the invention is somewhat similar to that of prior art apparatus. FIG. 2 shows an embodiment of an system according to the invention comprising a housing 12 of water cooler 10 similar to that of a conventional water cooler. The system of FIG. 2, however, includes a collapsible water bag 30 and a carrier bowl 32 for the bag. FIG. 3 shows a perspective view of the housing 12 and bowl 32. Water is supplied to reservoir 16 similar to the water from the collapsible water bag 30. The bag 30 is located in a bowl 32 which is of molded rigid plastics material construction. The plastics material may be food grade plastics, for example, food grade PVC. The bowl 32 has a skirt 34 which acts as a stand to locate the bowl on the top of the housing 12.

A conventional water cooler such as water cooler 10 is frequently provided with a housing of generally parallelepiped shape. It is, however, convenient that the carrier bowl 32 for bags 30 have a generally hemispherical shape so that it is easy to clean. Because of these facts, although there are no limitations on the shape of the bowl 32 and the skirt 34, it may be convenient that the integral bowl and skirt unit has a shape generally as illustrated.

The skirt 34 may be of any conventional shape to stand on top of housing 12 but, when housing 12 is taken from a conventional water cooler and has a square or rectangular top, it may be convenient that the base of the skirt 34 conform to that shape although the bowl itself is preferably of circular horizontal section. The circular top of the bowl 32 may merge smoothly with the square base of skirt 34.

The rim of the bowl 32 may conveniently be provided with an indented shoulder 54 on which may rest a circular lid or cover 56. Lid or cover 56 may protect the bag 30 from dust dirt and bacteria when it is installed in the bowl 32.

The skirt 34 may be provided with strengthening ribs internally or externally. Conveniently, such ribs 58 are provided internally of the skirt and are wider at the bottom than at the top to form sturdy feet 60 for the skirt. Feet 60 rest on the top of water cooler 10 outwardly of saucer 22 which is conventionally provided for such coolers for use with bottles.

At the bottom of the bowl 32 there is located a hollow spike 36 to puncture a bag 30 placed in the bowl 32 and to drain water from it. The spike 36 may have various constructions such as those shown in more detail in FIGS. 5 and 6 which will be discussed later. The overriding consideration for spike 36 is that it be sharp enough to puncture the bag 30 either under the weight of the bag or when a little downward pressure is exerted on the bag, and that it is provided with a drain port or ports 38 at a level to drain substantially all the water from the bag 30.

Water draining from the bag 30 through drain ports 38 is led downwardly through conduit 40 to cooling reservoir 16 of the water cooler 10. As water is drained from the bag 30 atmospheric pressure will act on it to collapse it rather than to reduce pressure inside it and hold water in it. Therefore a control valve 42 is provided to prevent continuous escape of water from it. Control valve 42 may conveniently be a ballcock supply valve. When the level of water in cooling reservoir 16 drops, flotation ball 44 also drops and allows water to flow from conduit 40 into the cooling reservoir.

A system according to the invention may minimize some of the problems associated with the conventional system shown in FIG. 1 while allowing use of the conventional water cooler 10 with its conventional housing 12, cooling reservoir 16 and access tap 14. It is, of course, possible to provide other coolers having a cooling reservoir. Provided that the cooling reservoir may be arranged below the bag 30, the design of the cooler may not be important.

One of the major problems of prior art water dispensing systems has been hygiene. A conventional water dispensing systems shown in FIG. 1 suffers from various problems in that the water bottles 20 are sufficiently expensive to be worth reusing. Therefore, the water bottles 20 must be sterilized before reuse. Such sterilization is expensive and may not be wholly reliable. Worse, if the user fails to keep their water cooler clean and problems with mold or bacteria arise, the user fairly or unfairly blames the water supplier who may be liable for very heavy damages. At the very least the user may change their supplier.

The water bags 30 of the present invention are much less expensive than the water bottles 20 and may be discarded after only one use. The water bags 30 may be made from food grade polyethylene sheet having a strength sufficient for support when filled with water. Conveniently the sheet thickness may be 3 mil. The polyethylene may be of the type and gauge generally used for milk bags. Of course it is possible to vary the strength and gauge depending on the size of the bags used and the requirements.

Figure 4A:
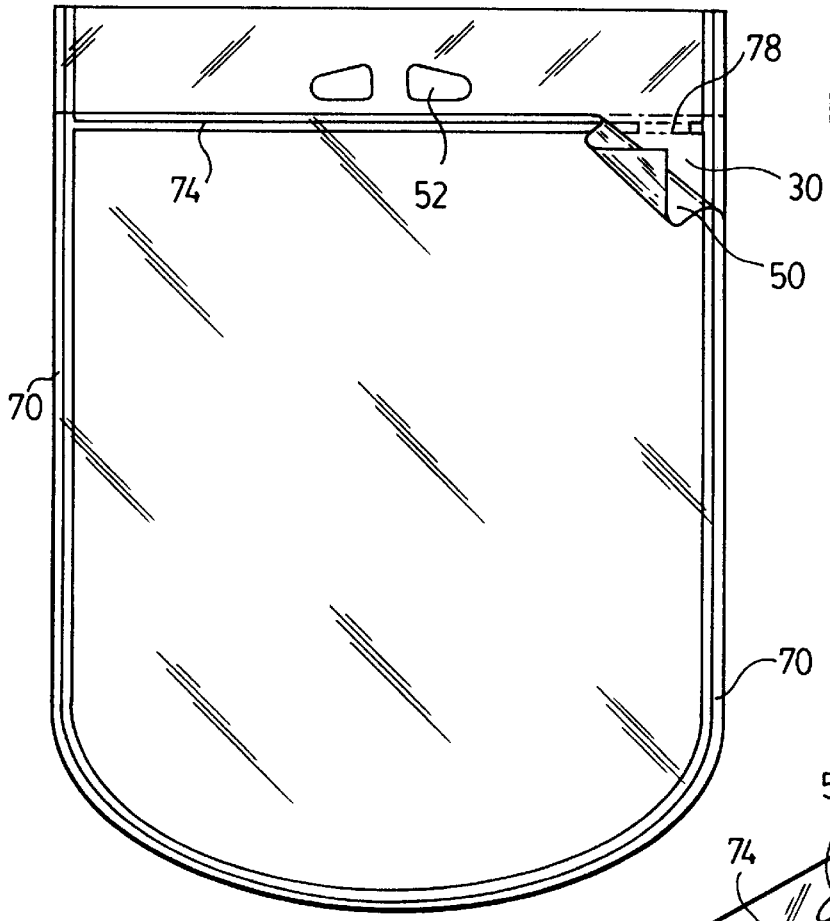
FIGS. 4A and 4B show a bag having a peel-off cover respectively empty and filled.
Figure 4B:
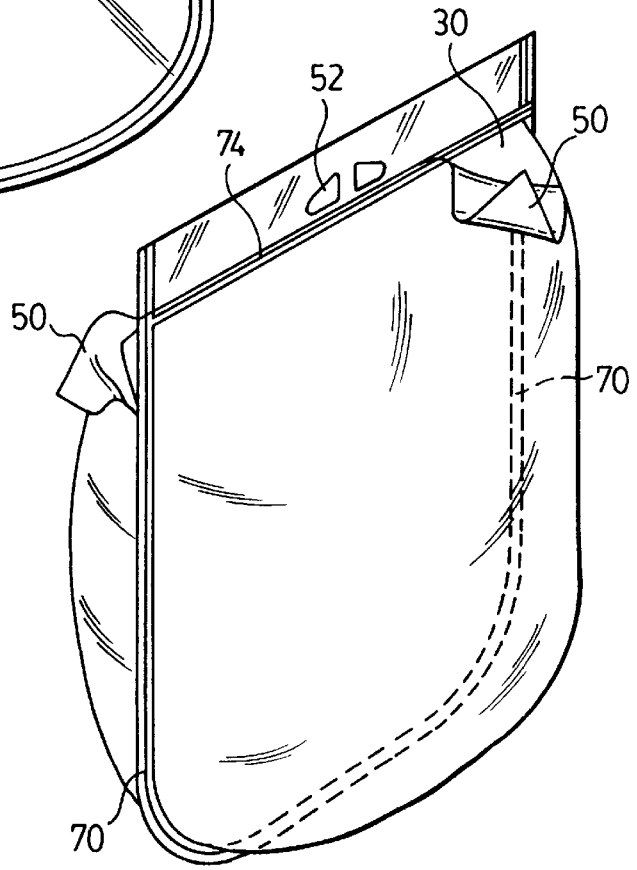

Suitably the design of the bag may be similar to those carrier bags provide by retail stores but curved at their bottom to fit the bowl 32. Such bags may be heat sealed at their bottom and each side (see FIGS. 4A and 4B). For use as water bags in the present invention bags 30 may have a heat seal 70 extending over the sides and bottom.

If the bags 30 are to be filled by means of a nozzle, then an additional top heat seal 74 may be provided extending most of the distance across the top leaving only a small aperture 78 for insertion of a filling nozzle. The small aperture 78 is thereafter sealed.

On the other hand filling machinery is available for use with bag having no top seal. Water is poured into open bags. Means are provided to draw the top edges of the bag together for subsequent heat sealing.

For hygiene during storage and transport, the bags 30 may be provided with a removable outer cover panels 50 (see FIG. 4) which can be peeled away from the bag 30 immediately before use. The bags 30 complete with removable cover panels 50 may be transported or stored in reusable crates which do not need sterilization because they only come into contact with removable panels 50. The removable outer panels 50 are conveniently provided as a single panel on each planar panel of bag 30 but more cover panels per planar of oag 30 may be used if desired provided that they fit together to cover the surface of the basic bag.

Another problem associated with the conventional water bottles 20 is that they are very hard to handle by many people. They must up-ended and located with their neck in the central aperture of saucer 22 of the water cooler in a smooth fast movement to avoid much spillage. When water bottles 20 are full they are quite heavy and location of them on a water cooler 12 is impossible for some people.

In contrast, bags 30 may be provided with a handle 52 for easy manipulation. The handle may be stamped from the polyethylene sheets forming the bag. They may be lifted to a position above the bowl 32 without fear of spillage. Water does not escape from the bag until it is punctured by spike 36.

Conduit 40 connects to a downwardly extending prong of spike 36 which extends through the bottom of bowl 32. The connection between conduit 40 and prong 61 of spike 36 may be by screw threading. Conveniently, a seal 63 of food grade plastics material is provided between the conduit and the downwardly extending prong 61. The seal 63 may include a sealing washer about the prong 61 below the bottom of bowl 32. The washer may alleviate dripping from the bowl of any water which might leak from the bag into the bowl and which might not be sterile.

Conduit 40 then leads downwardly into cooler reservoir 16. Conveniently it enters cooling reservoir 16 at a side thereof so that it is possible to provide cooling reservoir 16 with a lid or cover 62 to inhibit entry of dust, dirt and bacteria. Flow of water in conduit 40 is controlled through ballcock supply valve 42 as previously described.

Figure 5:
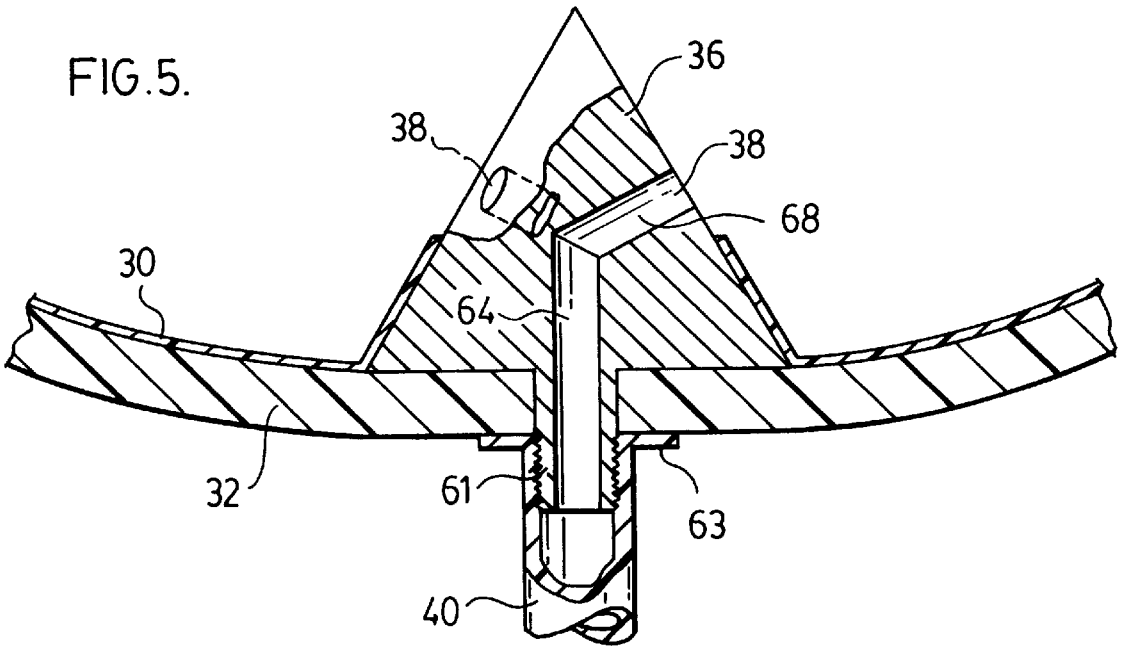
FIG. 5 shows a cone shaped extension for the conduit in more detail.

Spike 36 may advantageously be a cone as shown in FIG. 5. The cone has a hollow cavity 64 and drain ports 38 in its conical surface. Drain ports 38 supply drain conduits 68 which lead into the hollow cavity 64.

The height of drain port 38 above the bottom of bowl 32 is important. When the bag 30 is punctured by the apex of the cone 36, the weight of the bag containing water acts to force the bag downwardly so that the aperture formed by the sharp apex of the cone 36 tends to be stretched over the wider part of the cone. This is advantageous in that the stretching of the bag over the wider part of the cone tends to form a good seal with the cone. It is, however, possible that there may be some minor wrinkling of the bag around the cone. In particular edges of the aperture may turn up slightly around the cone. For this reason, it may not be appropriate to locate drain ports 66 immediately adjacent the bottom of bowl 32 because they might be fowled by any turned up portion of bag 30. It is also not appropriate to place the drain port 38 too high so that water is left in the bag below the level of such drain ports. The drain ports 38 should, therefore, be located as low as is reasonably possible without risk of fowling by the bags edges. It is believed that the drain ports may very suitably be located at a height between point 0.25 cm. to 1 cm. above the bottom of the bowl although location of different heights is also possible. Most preferably the drain port may be located between 0.25 cm. and 0.5 cm. above the bottom of the bowl.

Figure 6:
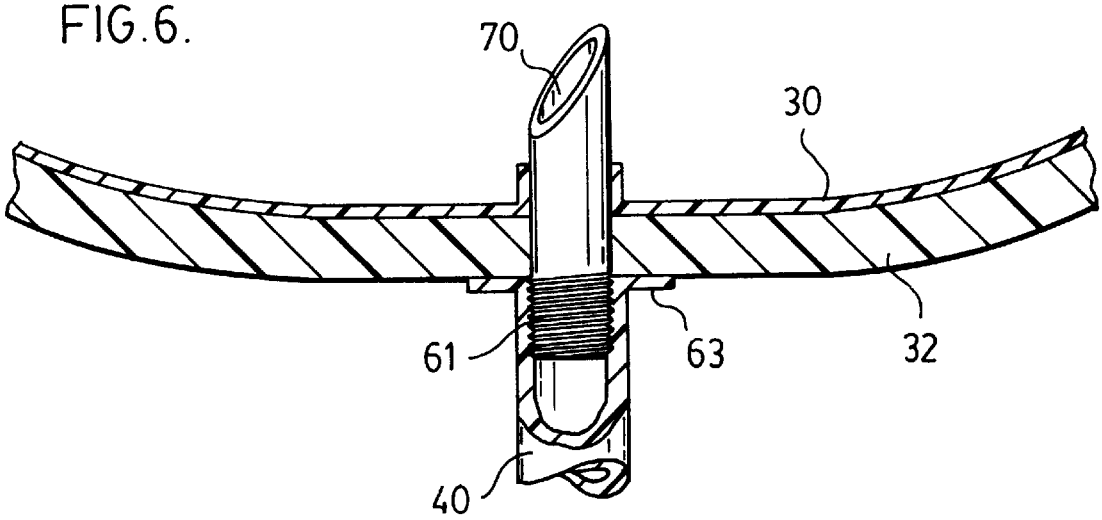
FIG. 6 shows another suitable extension for the conduit.

When the spike 36 is as shown in FIG. 6 somewhat similar considerations apply. Since the tube of spike 36 does not widen towards its base, there may be less wrinkling of the bag about the tube but this is offset by the fact that the seal between the bag and tube may be less good than for the embodiment of FIG. 5. Although there may be less wrinkling of the bag about the tube, some allowance should still be made for it. The slanting port 70 of the tube should no approach the bottom of the bowl so closely that leakage of water into the bowl between the tube and bag is likely. If water leaks into the bowl 32 from the bag 30, it will contact non-sterile surroundings. If any such water then leaks from the bowl to drip into the cooling reservoir 16 it could contaminate the water therein. It is for this reason that various precautions are taken to stop such contamination. An effort has been made to provide a good seal between the bag and the spike 36 whether it be a cone or a hollow tube, and a seal has been provided below the bottom of the bowl with a view to prevent dripping of any water from the bowl, and a lid 62 has been provided for the cooling reservoir.

I claim:

1. A water dispensing system, comprising:

a cooler having a cooling reservoir replenishable from above;

a collapsible, sealed, plastic bag of water;

a connector between said cooler and said bag comprising a bowl for said bag;

a stand for holding the bowl above the cooling reservoir of said cooler, the stand and the bowl being an integral rigid molding of plastics material;

a conduit for water extending between the bowl and the cooling reservoir;

means within said bowl to penetrate said bag when said bag is placed within said bowl to allow water to flow into said conduit; and valve means to control flow of water from the conduit in dependence on the level of water in the water reservoir.

2. A water dispensing system as claimed in claim 1 in which the plastics material is polyvinylchloroethylene.

3. A water dispensing system as claimed in claim 1 in which said conduit has a hollow extension upstanding from a bottom internal surface of said bowl to terminate in a sharp end to penetrate said bag for communication on the one hand, with the conduit and, on the other hand, through at least one drain hole with the interior of the bag.

4. A water dispensing system as claimed in claim 3 in which said conduit has inlet means to drain water from substantially a lowermost part of the bag.

5. A water dispensing system as claimed in claim 4 in which the inlet means extends sufficiently above said bottom internal surface of the bowl to access the interior of the bag.

6. A water dispensing system as claimed in claim 5 in which said conduit extension comprises a hollow cone having a sharp closed apex and an open into the conduit through its base, said inlet means comprising at least one aperture through the sidewall of said cone.

7. A water dispensing system as claimed in claim 6 in which a sepal is provided between said extension and said conduit.

8. A water dispensing system as claimed in claim 1 in which said bag is formed from food grade polyethylene sheet.

9. A water dispensing system as claimed in claim 8 in which the polyethylene film has a gauge from 2 mil to 5 mil.

10. A water dispensing system as claimed in claim 8 in which said bag is provided with peel-off cover panels for removal before placing said bag in said bowl.

11. A water dispensing system as claimed in claim 8 in which the bag has a handle at a top end thereof.

12. A water dispensing system as claimed in claim 1 in which the valve means to control flow of water in the conduit is a ballcock supply valve in the cooler reservoir.

* * * * *